US007566519B2

(12) United States Patent
Kobayashi et al.

(10) Patent No.: US 7,566,519 B2
(45) Date of Patent: Jul. 28, 2009

(54) CARRIER FOR ELECTROPHOTOGRAPHIC DEVELOPER, AND ELECTROPHOTOGRAPHIC DEVELOPER USING THE SAME

(75) Inventors: Hiromichi Kobayashi, Kashiwa (JP); Tsuyoshi Itagoshi, Kashiwa (JP); Tomoyuki Suwa, Kashiwa (JP); Toshio Honjo, Kashiwa (JP)

(73) Assignee: Powdertech Co., Ltd., Kashiwa-shi, Chiba (JP)

( * ) Notice: Subject to any disclaimer, the term of this patent is extended or adjusted under 35 U.S.C. 154(b) by 572 days.

(21) Appl. No.: 11/509,707

(22) Filed: Aug. 25, 2006

(65) Prior Publication Data

US 2007/0048649 A1 Mar. 1, 2007

(30) Foreign Application Priority Data

Aug. 25, 2005 (JP) ..... 2005-244367

(51) Int. Cl.
*G03G 9/083* (2006.01)

(52) U.S. Cl. ..... 430/111.35; 430/111.31; 430/111.32

(58) Field of Classification Search ..... 430/111.31, 430/111.32, 111.35
See application file for complete search history.

(56) References Cited

U.S. PATENT DOCUMENTS 5,994,015 A * 11/1999 Vail ..... 430/111.35
5,998,076 A * 12/1999 Mahabadi et al. ..... 430/111.32

* cited by examiner

*Primary Examiner*—Hoa V Le
(74) *Attorney, Agent, or Firm*—Rothwell, Figg, Ernst & Manbeck, P.C.

(57) ABSTRACT

A carrier for an electrophotographic developer which is used as an electrophotographic developer in a mixture with a toner and which secures sufficiently the image density and can maintain high-quality images for a long period, and an electrophotographic developer using the carrier, are provided. A resin-filled ferrite carrier for electrophotographic developer obtained by filling, with a resin, avoid of a porous ferrite core whose void continues from the surface to reach the interior of the core, the carrier comprising a plurality of three-dimensional laminate structures in which resin layers and ferrite layers are alternately present, and an electrophotographic developer including the carrier and a toner, are employed.

7 Claims, 2 Drawing Sheets

CARRIER FOR ELECTROPHOTOGRAPHIC DEVELOPER, AND ELECTROPHOTOGRAPHIC DEVELOPER USING THE SAME

BACKGROUND OF THE INVENTION

1. Field of the Invention

The present invention relates to a carrier for an electrophotographic developer used for a two-component electrophotographic developer used in copiers, printers and the like and to an electrophotographic developer using the carrier, and relates particularly to a carrier for an electrophotographic developer comprising a resin-filled ferrite carrier which has a low true density and an elongated life, and is high in the charge imparting capability and stable, and to an electrophotographic developer using the carrier.

2. Description of the Related Art

The electrophotography is a method of developing by adhering toner particles in a developer to electrostatic latent images formed on a photoreceptor, and the developer used in this method is divided into a two-component developer composed of toner particles and carrier particles and a one-component developer composed of toner particles alone.

Among such developers, as the electrophotography using the two-component developer composed of toner particles and carrier particles, the cascade method used to be employed, but at present the magnetic brush method using a magnet roll is the mainstream.

In a two-component developer, the carrier particle is a carrier material which is mixed and stirred with the toner particle in a developing box filled with developer to impart a desired charge on the toner particle, further transports the charged toner to the surface of a photoreceptor to form toner images on the photoreceptor. The carrier particles remaining on a developing roll holding a magnet is again returned into the developing box from this developing roll, mixed and stirred with fresh toner particles, and repeatedly used in a certain period.

A two-component developer has, different from a one-component developer, functions of being mixed and stirred with toner particles, charging and further transporting the toner particles, and has a favorable controllability in designing a developer. Therefore, the two-component developer is suitable for full-color developing machines requiring high-quality images, high-speed printing machines requiring reliability and durability of image sustainability, and the like.

The two-component developer used in such a way needs to exhibit prescribed values from the initial stage in image characteristics such as image density, fogging in image, white spots, gradation and resolution, which also need not to vary in the continuous printing period and to be stably maintained. For stably maintaining these characteristics, the characteristics of the carrier particles contained in the two-component developer need to be stable.

As a carrier particle forming a two-component developer, an iron powder carrier such as an iron powder covered on its surface with an oxide film or an iron powder coated on its surface with a resin is conventionally used. Since such an iron powder carrier has a high magnetization and a high conductivity, it has an advantage of easily obtaining images good in the reproducibility of solid parts.

However, since such an iron powder carrier has a large true specific gravity of about 7.8 and too high a magnetization, stirring and mixing with toner particles in a developing box becomes liable to generate the fusion of the toner-constituting components onto the iron powder carrier surface, the so-called toner spent. Such a toner spent generation reduces the effective carrier surface area, and becomes liable to decrease the tribocharging capability with the toner particle.

In the resin-coated iron powder carrier, exfoliation of the surface resin due to stresses during endurance and exposure of the core (iron powder) high in conductivity and low in isolation breakdown voltage sometimes cause the charge leak. By such a charge leak, electrostatic latent images formed on a photoreceptor are broken; brush streaks and the like are generated on solid parts; and uniform images are hard to obtain. From these reasons, iron powder carriers such as an oxide-filmed iron powder and a resin-coated iron powder come not to be used at present.

As described in Patent Document 1 (Japanese Patent Laid-Open No. 59-48774), resin-coated ferrite carriers have been recently often used in which a ferrite core, which has a low true specific gravity of about 5.0 and also a low magnetization, is used in place of the iron powder carriers and the surface is coated with a resin, whereby the developer life has remarkably been elongated.

However, with evolution from an era of simple function copiers to that of combined machines with recently progressing office networking, and with the service systems shifting from a system where contracted servicemen periodically exchange developers, etc. for maintenance to a maintenance-free era, the market comes to have the larger demand for the more elongated life of the developers.

Further, offices come to accept full-color images and have the larger demand for high-quality images, and the toner particle size becomes smaller to obtain a high resolution.

Corresponding to this, the carrier particle size also has shifted to the small particle size having a high specific surface area with the need for quick charging of the toner in a desired charge. When the particle size distribution is totally made to be of small particle size, especially particles on the fine powder side become liable to bring about the phenomenon of the carrier particles scattering or adhering to a photoreceptor, the so-called carrier adhesion, and induce fatal image faults such as white spots. Therefore, the small particle size carrier must be controlled more narrowly in the particle size distribution width.

In such a situation, many magnetic powder-dispersed carriers in which fine magnetic microparticles are dispersed in resins are proposed in Patent Document 2 (Japanese Patent Laid-Open No. 05-40367), etc. to make the carrier particles light, and elongate the developer life.

Since such magnetic powder-dispersed carriers can be decreased in their true densities by reducing the magnetic microparticle amount, thus reducing the stress by stirring, the chipping and exfoliation of the coated film is prevented, thereby providing stable image characteristics for a long period.

However, since the magnetic powder-dispersed carriers are coated on the magnetic microparticles with binder resins, the carrier resistance is high. Therefore, they have a problem of having difficulty in providing a sufficient image density.

The magnetic powder-dispersed carriers sometimes raise such problems that magnetic microparticles are solidified with binder resins, and drop off by the stirring stress and the impact in developing machines, and that the carriers themselves break possibly due to their inferior mechanical strengths as compared with those of iron powder carriers and ferrite carriers conventionally used. Then, added dropwise-off magnetic microparticles and the broken carrier particles adhere to a photoreceptor, and sometimes cause image faults.

Additionally, the magnetic powder-dispersed carriers have a disadvantage of having a high residual magnetization and a high coercive force because of use of fine magnetic microparticles, and deteriorating the fluidity of the developers. Especially when magnet brushes are formed on a magnet roll, high-quality images are difficult to obtain because bristles of the brushes become hard due to the high residual magnetization and coercive force. Further, even when the carrier leaves the magnet roll, since the carrier magnetic aggregation does not come loose, and the carrier cannot be rapidly mixed with a supplied toner, the rising of the charge quantity is bad, there by raising a problem of causing image faults such as toner scattering and fogging in images.

Further, although the magnetic powder-dispersed carriers can be fabricated by two methods of the crushing one and the polymerization one, both have a problem of a high producing cost because the crushing method is bad in yield, and the polymerization method is complicated in the producing process.

Resin-filled type carriers in which voids in a porous carrier core are filled with a resin are proposed as one in place of the magnetic powder-dispersed carriers. For example, Patent Document 3 (Japanese Patent Laid-Open No. 11-295933) and Patent Document 4 (Japanese Patent Laid-Open No. 11-295935) describe a core or a hard magnetic core, polymers contained in the core pores, and carriers including coatings which coat the cores. These resin-filled type carriers are supposed to provide carriers which have little impact, desired fluidities, wide ranges of tribocharging values, desired conductivities, and certain ranges of the volume average particle sizes.

Here, Patent Document 3 supposes that as the core, various appropriate porous solid core carrier materials such as existing porous cores can be used. It describes that especially important are the porousness and the desired fluidity, and lists the soft magnetization, the porosity indicated by the BET area and the volume average particle size as noteworthy properties.

However, the porosity of about 1,600 $cm^2/g$ in BET area as described in an example of the Patent Document cannot provide a sufficiently low specific gravity even when filling with a resin, and cannot respond to the recently increasing need for the elongated life of developers.

Further, a sponge iron powder used in an example of the Patent Document cannot provide a sufficiently low specific gravity even when filling with a resin, and cannot at all come up to the desired elongated life.

Further, as described in the Patent Document, only by simply controlling the porosity expressed by the BET area, the specific gravity and mechanical strengths of a carrier after the resin filling are difficult to precisely control.

The measurement principle of BET area is to measure the physical adsorption and the chemical adsorption of a specific gas, and has no correlation with the core porosity. That is, even a core with pores scarcely present generally varies in the BET area depending on its particle size, particle size distribution, surface material quality, etc. Then, even if the porosity is controlled through the BET area measured in such a way, the core cannot be said to be one which can be filled fully with a resin. When a core with a high BET area but no or almost no pores is attempted to be filled with a large amount of a resin, the unfilled residual resin is present independently without adhering to the core, floats in the carrier, generates much aggregation of the particles, deteriorates the fluidity, largely varies charging characteristics on loosening of the aggregate in actual use periods, and so on, thereby making obtaining of stable characteristics difficult.

Additionally, only by controlling the BET area, a resin-filled carrier having three-dimensional laminate structures in which resin layers and ferrite layers are alternately present as in the present invention cannot be obtained.

Additionally, the Patent Document uses a porous core, and sets the total content of a resin with which the core is filled and a resin applied to the surface thereof to be preferably about 0.5 to about 10 wt % of the carrier. Further, in an example in the Patent Document, the resins do not amount to at most 6 wt % to the carrier. Such a small amount of the resins cannot achieve a desired low specific gravity, and can only provide performances similar to those of conventionally used resin-coated carriers.

Use of a hard magnetization core as described in Patent Document 4 brings about a disadvantage of worsening the fluidity of the developer because of its high residual magnetization and coercive force. Especially when magnet brushes are formed on a magnet roll, high-quality images are difficult to obtain because the bristles of the magnetic brushes become hard due to the high residual magnetization and coercive force. Further, even when the carrier leaves the magnet roll, since the carrier magnetic aggregation does not come loose, and the carrier cannot be rapidly mixed with a supplied toner, the rising of the charge quantity is bad, thereby raising a problem of causing image faults such as toner scattering and fogging in images.

Patent Document 5 (Japanese Patent Laid-Open No. 54-78137) describes a carrier for an electrostatic image developer in which pores and surface recesses of magnetic particles which have a lower bulk specific gravity than a substantially non-porous one and which are porous or have a large surface roughness are filled with a fine powder of an electric insulation resin, and contends that a developer is provided by using the carrier, which has advantages that, with the carrier having little toner accumulation on the carrier surface, the developer has stable powder characteristics and tribocharging characteristics under varying temperature and humidity conditions, and has a constant image density and no decrease in the image density with time lapse.

However, when pores of magnetic particles which are porous or have a large surface roughness are filled with a fine powder, if the iron powder is used as described in an example of the Patent Document, the pores are relatively easily filled with the fine powder, but is difficult to fill very fine voids with such a powder as is the case with voids in ferrite cores.

When trying to fill with a fine powder dispersed in a solvent, if the core is an iron powder, pores can be filled relatively uniformly as described above, but if the core is a ferrite one, the solvent only permeates voids of the core, thereby resulting in the dispersed fine powder present on the core surface. The powder easily drops off by being subjected to the mechanical stress in developing machines, leading to disadvantages of remarkable changes in the charging characteristics and resistance characteristics.

As described above, even the resin-filled carriers described in Patent Documents 3 to 5 cannot sufficiently satisfy the needs that the image density is sufficiently secured, and high-quality images can be maintained for a long period.

Especially, the resin-filled carriers disclosed in Patent Documents 3 to 5, which are obtained by filling with a fine powder of a resin or an electric insulation resin, are in their forms substantially no more than a carrier having an increased resin amount of a conventionally known carrier which is coated with a resin on its surface, and a carrier on such a level that the fine powder penetrates a few pores, and are not at a satisfiable level with respect to the charge imparting capability and its stability.

Accordingly, an object of the present invention is to provide a carrier for an electrophotographic developer which is used by mixing the carrier with a toner, sufficiently secures the image density and can maintain high-quality images for a long period, and an object to provide an electrophotographic developer using the carrier.

SUMMARY OF THE INVENTION

As a result of extensive studies to solve the above-mentioned problems, the present inventors have found that for maintaining high-quality images for a long period, the above-mentioned objects can be accomplished by making a resin-filled ferrite carrier having three-dimensional laminate structures in which resin layers and ferrite layers are alternately present, and achieved the present invention.

That is, the present invention provides a resin-filled ferrite carrier obtained by filling, with a resin, a void of a porous ferrite core whose void continues from the surface to reach the core, the carrier comprising a plurality of three-dimensional laminate structures in which resin layers and ferrite layers are alternately present.

In the carrier for an electrophotographic developer according to the present invention, the above-mentioned three-dimensional laminate structure is preferably three or more times.

In the carrier for an electrophotographic developer according to the present invention, the above-mentioned three-dimensional laminate structure is present preferably at least in the part of a depth of 10% or more of the radius in the diameter direction depth from the particle surface toward the particle center.

The carrier for an electrophotographic developer according to the present invention is coated preferably on 50% or more of the outermost surface with a resin.

The carrier for an electrophotographic developer according to the present invention has preferably a true density of 2.5 to 4.5 g/cm$^3$, an apparent density of 1.0 to 2.3 g/cm$^3$ and an average particle size of 20 to 40 μm.

The carrier for an electrophotographic developer according to the present invention has preferably a residual magnetization of 5 emu/g (A·m$^2$/kg) or less, and a magnetization of 40 to 75 emu/g (A·m$^2$/kg).

Further, the present invention is to provide an electrophotographic developer comprising the above-mentioned carrier for an electrophotographic developer and a toner.

Since the carrier for an electrophotographic developer according to the present invention is a resin-filled ferrite carrier obtained by filling voids of a porous ferrite core whose voids continue from the surface to reach the core interior with a resin, the true density becomes low, allowing an elongated life; and since it has three-dimensional laminate structures in which resin layers and ferrite layers are alternately present, and a capacitor-like property, it is excellent in the charge imparting capability and its stability. Moreover, it has a high strength in comparison with a magnetic powder-dispersed carrier, and does not generate cracking, deformation and melting by heat and impact.

DETAILED DESCRIPTION OF THE PREFERRED EMBODIMENTS

Hereinafter, preferred embodiments for practicing the present invention will be explained.

<A Carrier for an Electrophotographic Developer According to the Present Invention>

A carrier for an electrophotographic developer according to the present invention is a resin-filled ferrite carrier obtained by filling voids of a porous ferrite core whose voids continue from the surface to reach the core interior with a resin, and has three-dimensional laminate structures in which resin layers and ferrite layers are alternately present. The three-dimensional laminate structure here referred to as is one in which when a straight line (diameter) is drawn passing through the particle center in a carrier particle cross-section, resin layers and ferrite layers are alternately in plural numbers present between one end and the other end of the particle along the line.

Figure 1:
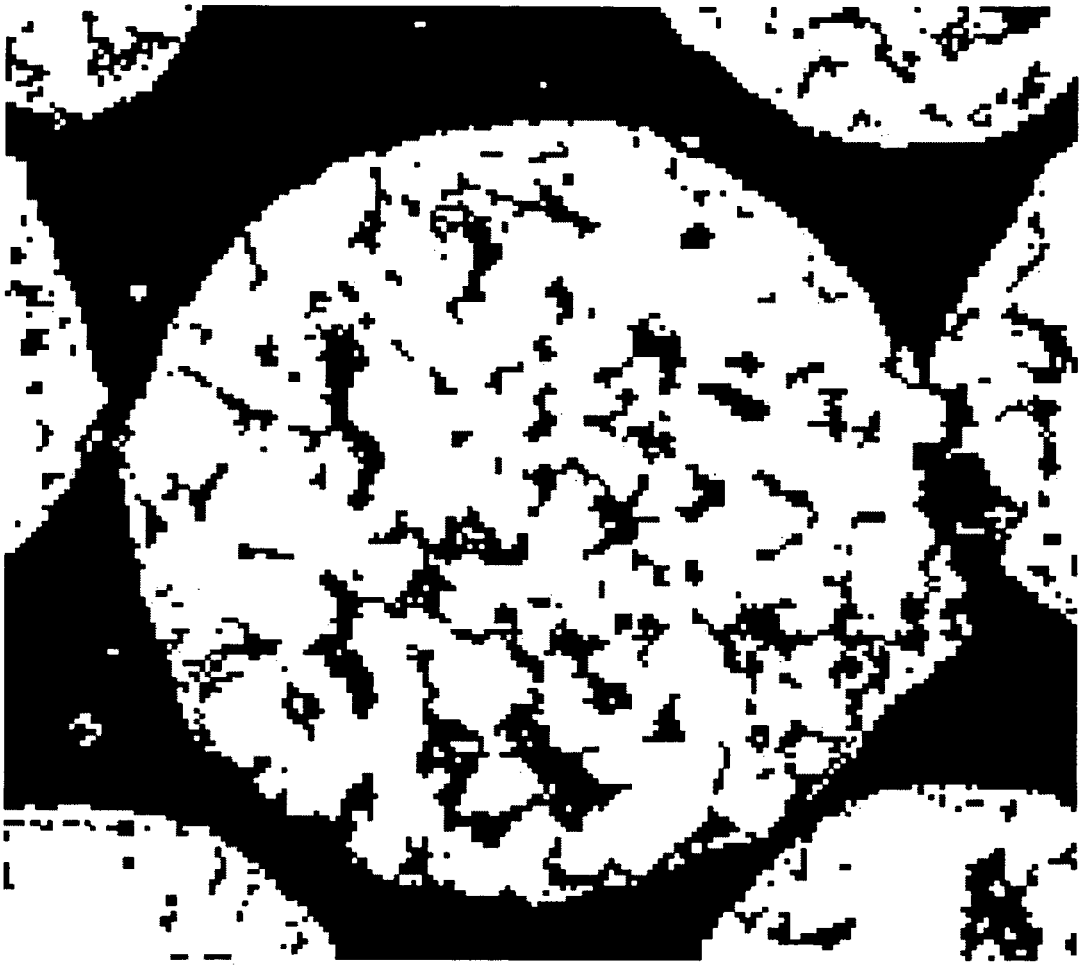
FIG. 1 is a cross-sectional photograph of a resin-filled carrier particle in Example 1 by a scanning electron microscope.

A photograph of a cross-section of the carrier for an electrophotographic developer according to the present invention is shown in FIG. 1. As clarified from FIG. 1, the carrier for an electrophotographic developer according to the present invention is found to have resin layers and ferrite layers alternately in plural numbers.

Figure 2:
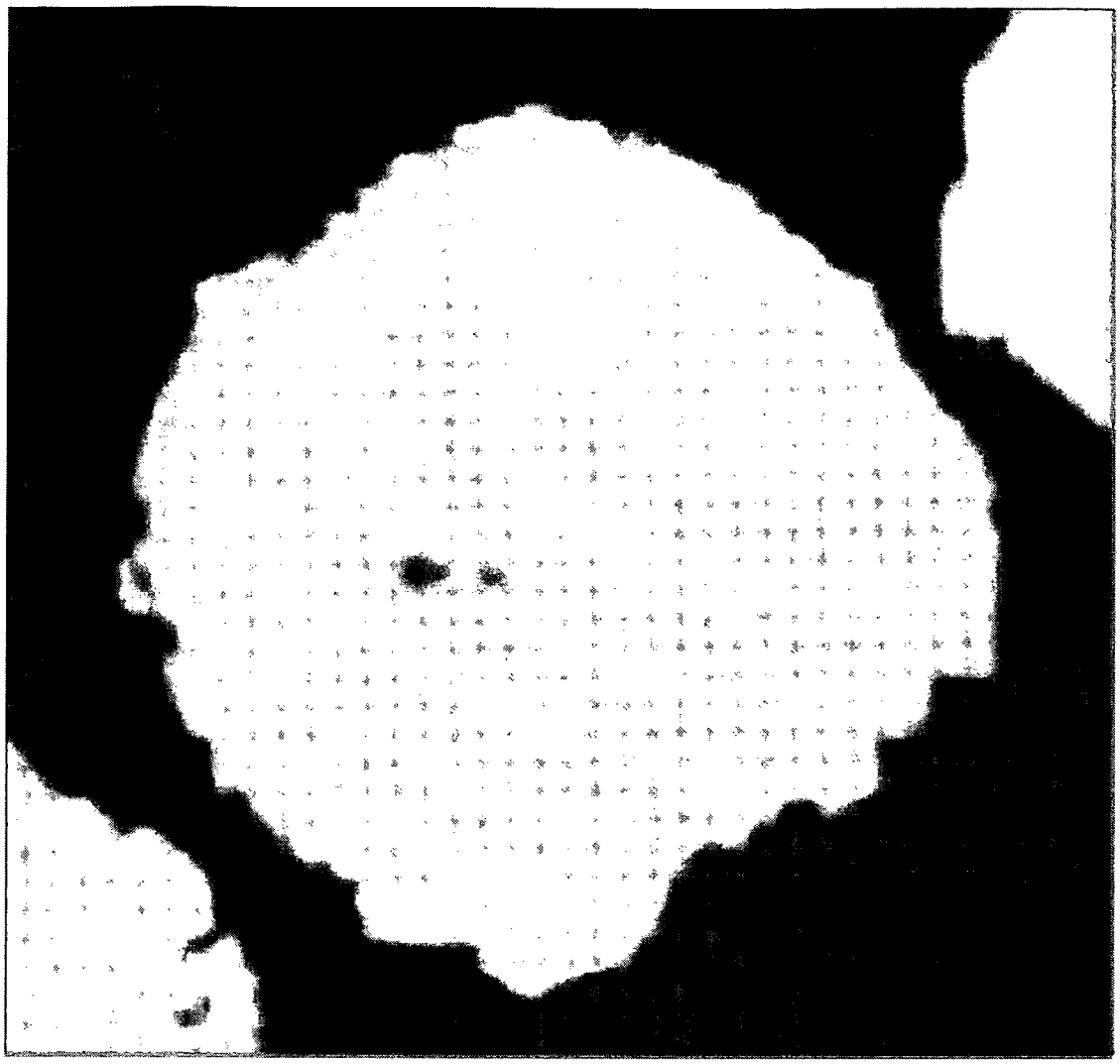
FIG. 2 is a cross-sectional photograph of a carrier particle in Comparative Example 3 by a scanning electron microscope.

A photograph of a cross-section of a conventional resin-coated carrier is shown in FIG. 2. As clarified from FIG. 2, the conventional resin-coated carrier has a resin layer on the particle surface, and an inorganic particle such as ferrite inside thereof. Namely, the repeating number of the resin layer-ferrite layer-resin layer (a structure in which a ferrite layer is interposed between resin layers: laminate structure) is only one.

With resin layers and ferrite layers present alternately in plural numbers as in the present invention, the particle has a strong function of being capacitor-like, thereby being excellent in the charge imparting capability and its stability.

The carrier for an electrophotographic developer according to the present invention has at least two times in the repeating number of the resin layer-ferrite layer-resin layer (a structure in which a ferrite layer is interposed between resin layers: laminate structure), preferably three times or more, further preferably four times or more. This results in fully exhibiting a capacitor-like function. Now, a straight line (diameter) is drawn passing through the particle center in a carrier particle cross-section, and the repeating number of the resin layer-ferrite layer-resin layer between one end and the other end of the particle along the line is measured; and the number of laminate structures of the carrier particle is allowed to denote an average value of the numbers measured in respect to a plurality of the particles.

In the carrier for an electrophotographic developer according to the present invention, the above-mentioned three-dimensional laminate structure is present preferably at least in the part of a depth of 10% or more of the radius in the diameter direction depth from the particle surface toward the particle center. When there is the three-dimensional laminate structure only in the uppermost surface, the carrier is sometimes not different from conventional resin-coated carriers. For fully exhibiting the capacitor-like function, enhancing the charge imparting capability and stabilizing the characteristics, the three-dimensional laminate structure is present preferably at least in the part of a depth of 10% or more, preferably even in the part of a depth of 20% or more, of the radius in the diameter direction depth from the particle surface toward the particle center.

In the carrier for an electrophotographic developer according to the present invention, at least 50% of the outermost surface of the resin-filled ferrite carrier having the three-dimensional laminate structure is preferably coated with a resin. With the resin layer present on the outermost surface, the whole particle has a laminated capacitor-like structure and further improves in the charge imparting capability. For exhibiting this effect, at least 50% of, preferably at least 70% of, the outer most surface is preferably coated with a resin.

The carrier for an electrophotographic developer according to the present invention has preferably a true density of 2.5 to 4.5 g/cm$^3$, further preferably 2.8 to 4.0 g/cm$^3$, most preferably 3.0 to 4.0g/cm$^3$. With the true density of less than 2.5 g/cm$^3$, since the carrier true density is too low, and the fluidity worsens, the charging speed decreases and the magnetization per particle too much decreases, thereby causing the carrier adhesion. With the true density exceeding 4.5 g/cm$^3$, since the true density is too high, the elongated life cannot be accomplished due to stresses during duration.

The carrier for an electrophotographic developer according to the present invention has preferably an apparent density of 1.0 to 2.3 g/cm$^3$. With the apparent density of less than 1.0 g/cm$^3$, the shape becomes bad and many projecting portions are liable to occur. Such portions are weak in mechanical stresses and brittle, reducing the strength and easily causing breakage of the carrier. With the apparent density exceeding 2.3 g/cm$^3$, the elongated life is hard to achieve.

The carrier for an electrophotographic developer according to the present invention has preferably an average particle size of 20 to 40 μm. The average particle size of less than 20 μm is not preferable because the carrier adhesion is easily generated. The average particle size exceeding 40 μm is not preferable because the image quality is easily deteriorated.

The carrier for an electrophotographic developer according to the present invention has preferably a residual magnetization of 5 emu/g (A·m$^2$/kg) or less. With the residual magnetization exceeding 5 emu/g (A·m$^2$/kg), the stirrability of the carrier with a toner becomes bad, thereby degrading the charging characteristics.

The carrier for an electrophotographic developer according to the present invention has preferably a magnetization of 40 to 75 emu/g (A·m$^2$/kg), further preferably 50 to 70 emu/g (A·m$^2$/kg). With the magnetization of less than 40 emu/g (A·m$^2$/kg), the carrier adhesion is unfavorably liable to be induced. With the magnetization exceeding 75 emu/g (A·m$^2$/kg), bristles of the magnetic brushes become high, unfavorably having difficulty in providing high-quality images.

The core of the carrier for an electrophotographic developer according to the present invention is composed preferably of a ferrite, more preferably one expressed by the formula $(MO)_x(Fe_2O_3)_y$ (wherein, y is 30 to 95 mol %). Wherein, M is preferably one or more kinds selected from the group consisting of Fe, Mn, Mg, Sr, Ca, Ti, Cu, Zn, Ni, Li and Al.

Here, when M is Fe, the ferrite denotes iron ferrite, i.e., magnetite. Ferrites are oxides of high order, and have little changing characteristics by mechanical stresses. Further, a low specific gravity is easily achieved. With $Fe_2O_3$ of less than 30 mol %, a desired magnetization is difficult to obtain, and the carrier adhesion is liable to occur. Especially, a ferrite made of a specific metal oxide raw material has little variation in compositions between the particles, and easily provides desired characteristics. The reason is not clarified, but a ferrite using the above-mentioned elements is, as compared with using other elements, high in the capacitor-like capability and excellent in the charge imparting capability and its stability.

Taking into consideration the current of the environmental load reduction including waste regulations in recent years, preferably, the heavy metals of Cu, Zn and Ni are not substantially contained.

A resin used in the carrier for an electrophotographic developer according to -the present invention can be suitably selected depending on a toner to be combined with, the environment in use and the like. The kind is not especially limited, but includes, for example, a fluororesin, acrylic resin, epoxide resin, polyamide resin, polyamide-imide resin, polyester resin, unsaturated polyester resin, urea resin, melamine resin, alkydresin, phenol resin, fluoroacrylic resin, acrylicstyrene resin, silicone resin, and a modified silicone resin modified by a resin such as an acrylic resin, polyester resin, epoxide resin, polyamide resin, polyamide-imide resin, alkyd resin, urethane resin, or fluororesin. Taking into consideration the drop-off of the resin by the mechanical stresses during use, a thermosetting resin is preferably used. The thermosetting resin specifically includes an epoxide resin, phenol resin, silicone resin, unsaturated polyester resin, urea resin, melamine resin, alkyd resin, and a resin containing these.

For the purpose of controlling the electric resistance, charge quantity and charging speed of the carrier, a conductive agent can be added to a resin for filling. Too much addition of the conductive agent easily causes a sharp charge leak because of the low resistance of the conductive agent itself. Therefore, the addition amount is 0.25 to 20.0 wt % to the solid content of the filling resin, preferably 0.5 to 15.0 wt %, especially preferably 1.0 to 10.0 wt %. The conductive agent includes a conductive carbon, an oxide such as titanium oxide or tin oxide, and various kinds of organic conductive agents.

In the above-mentioned resin, a charge control agent can be contained. The charge control agent includes, for example, various kinds of charge control agents commonly used for toners, and various kinds of silane coupling agents. This is because, although the charge imparting capability sometimes decreases when the core-exposed area is controlled by coating so as to be made relatively small, it can be controlled by addition of a charge control agent or silane coupling agent. The kind of a usable charge control agent and silane coupling agent is not especially limited, but is preferably a charge control agent such as a nigrosin dye, quaternary ammonium salt, organic metal complex or metal-containing monoazo dye, an aminosilane coupling agent, a fluorinated silane coupling agent, and the like.

<Measuring Methods>

Measuring methods of characteristics of the carrier for an electrophotographic developer according to the present invention will be described below.

(True Density)

The true density of a carrier particle is measured according to JIS R9301-2-1 by using a picnometer.

(Apparent Density)

The apparent density is measured according to JIS Z2504 (Metallic powders—Determination of apparent density).

(Average Particle Size)

The average particle size is measured using a Microtrac Particle Size Analyzer (Model: 9320-X100), manufactured by Nikkiso Co., Ltd.

(Magnetic Property)

The magnetization is measured using an integral-type B-H tracer BHU-60 (manufactured by Riken Denshi Co., Ltd.). An H coil for measuring magnetic field and a 4πI coil for measuring magnetization are put in between electromagnets.

In this case, a sample is put in the 4πI coil. Outputs of the H coil and the 4πI coil when the magnetic field H is changed by changing the current of the electromagnets are each integrated; and with the H output as the X-axis and the 4πI coil output as the Y-axis, a hysteresis loop is drawn on a chart. The measurement is conducted under the conditions of the sample filling quantity: about 1 g, the sample filling cell: inner diameter of 7 mmϕ±0.02 mm, height of 10 mm±0.1 mm, and 4πI coil: winding number of 30.

(Observation of Shape, Surface Property, and Cross-Sectional State)

The shape and surface property of carrier particles are observed and confirmed using a scanning electron microscope (JSM-6100, manufactured by JEOL Ltd.). The lamination state is observed by taking cross-section photographs of the carrier by the above scanning electron microscope.

(Charging Property)

The charge quantity is measured using a mixture of a carrier and a toner by a suction type charge measurement device (Epping q/m-meter, manufactured by PES-Laboratorium). As the toner, a negative polarity toner commercially available for full-color printers (cyan toner for DocuPrint C3530, manufactured by Fuji Xerox Co., Ltd.) is used by adjusting the toner concentration to 7 wt %.

Now, the initial charge quantity is allowed to be a charge quantity after the stirring of one minute with the toner; and the saturated charge quantity is allowed to be a charge quantity after the stirring of10 min. The smaller difference between the initial charge quantity and the saturated charge quantity means a higher charging speed, and a rapid mixing with the supplied toner in practical uses.

Further, the charge quantity after stress is allowed to be a charge quantity after the stirring of 36 h. This is to confirm weather or not the charge quantity varies by a long period stirring stress, and the charge quantity after stress nearer to the initial charge quantity and the saturated charge quantity means a more stable charging property.

(Carrier Strength)

The strength of a carrier is measured according to JIS K1474 (Test methods for activated carbon), as follows.

A sample of 50 g and each 30 steel balls of 5 mm and 12 mm in diameter are put in a test dish, and shaken for 20 min by a sieve shaker. Thereafter, the sample and the steel balls are divided, and the average particle size of the sample is measured. The changing rate in average particle size using the average particle sizes before and after shaking is calculated by the below expression, and a carrier strength is allowed to be the strength. A small strength means the carrier has been broken by mechanical stresses, and can be said to be a week one.

$$\text{Strength (\%)} = (\text{an average particle size after shaking}/(\text{an average particle size before shaking}) \times 100$$

(Toner Broken State)

The shape of the toner after the stirring of 36 h is observed and confirmed by a scanning electron microscope (JSM-6100, manufactured by JEOL Ltd.).

(Toner Spent)

A carrier only is sampled from the developer after the stirring of 36 h, and observed by a scanning electron microscope (JSM-6100, produced by JEOL Ltd.), and the toner amount fused to the carrier surface is measured using a carbon analyzer C-200, manufactured by LECO Corp.

<Production Method of a Carrier for an Electrophotographic Developer According to the Present Invention>

Then, a production method of a carrier for an electrophotographic developer according to the present invention will be explained.

For producing a ferrite core of a carrier for an electrophotographic developer according to the present invention, raw materials are weighed in appropriate amounts, and then crushed and mixed by a ball mill, vibration mill or the like for 0.5 h or more, preferably for 1 to 20 h. The crushed material thus obtained is pelletized using a pressure molding machine or the like, and calcined at a temperature of 700 to 1,200° C. After crushing, without using a pressure molding machine, it may be added with water and made into a slurry, and granulated using a spray drier. The calcined material is further crushed by a ball mill, vibration mill or the like, and then optionally added with a dispersant, a binder, etc., adjusted for its viscosity, granulated, and sintered at a temperature of 1,000 to 1,500° C. for 1 to 24 h while the oxygen concentration is controlled. In the case of crushing after calcination, the calcined material may be added with water and crushed by a wet ball mill, wet vibration mill or the like.

The above-mentioned crushing machine such as the ball mill or vibration mill is not especially limited, but preferably uses fine-particle beads having a particle size of 1 mm or less as a media to be used in order to disperse raw materials effectively and uniformly. By adjusting the size, composition and crushing time of the using beads, the crushing degree can be controlled.

The sintered material thus obtained is crushed, and classified and adjusted to desired particle sizes using existing classification methods including the air classification, mesh filtration method and precipitation method.

Thereafter, the electric resistance can be optionally adjusted by performing the oxide film treatment by heating the surface at a low temperature. The oxide film treatment is performed using common furnaces such as a rotary electric furnace or batch-type electric furnace, and the heat-treatment is performed, for example, at 300 to 700° C. The thickness of the oxide film formed by this treatment is preferably 0.1 nm to 5 μm. If less than 0.1 μm, the effect of the oxide film is unfavorably little. If more than 5 μm, the magnetization sometimes decreases, and too high a resistance sometimes occurs, unfavorably having difficulty in providing desired characteristics. The reduction may optionally be performed before the oxide film treatment.

Methods to control voids continuing from the surface to the inside of the ferrite core of the carrier for an electrophotographic developer as described above, involve kinds of raw material to be formulated, crushing degrees of raw materials, presence/absence of calcination, calcination temperatures, calcination time, binder amounts at granulation by a spray drier, water amounts, drying degrees, sintering methods, sintering temperatures, sintering time, crushing methods, reduction by hydrogen, and others. The controlling methods are not especially limited, but will be exemplified below.

That is, use of hydroxides and carbonates as raw materials to be formulated easily provide a high void fraction as compared with use of oxides. Use of oxides of Mn, Mg, Ca, Sr, Li, Ti, Al, Si, Zr, Bi, etc., as raw materials easily provide a low true density and apparent density as compared with use of oxides of heavy metals, Cu, Ni and Zn.

No calcination provides a higher void fraction and a lower apparent density. The calcination, when performed, at a lower temperature is apt to provide a higher void fraction, and a lower apparent density.

In the granulation by a spry drier, a more water amount, when raw materials are made into a slurry, is apt to provide more voids and a lower apparent density; and a lower sintering temperature is apt to provide a higher void fraction and a lower apparent density.

For obtaining a desired void fraction, true density and apparent density, these controlling methods can be used alone or in combination. A high void fraction generally has a tendency of having a low true density and apparent density.

However, since the influencing degrees of controlling factors on the characteristics vary, by using these in combination, a carrier core composed of a ferrite whose apparent density does not become too low even with a high void fraction can be obtained.

An especially favorable configuration is, for satisfying all of the stirrability with a toner, the magnetization per particle, the elongated life and the stability of charge property, a carrier core which collectively has characteristics as conventionally are not simultaneously achieved because of the characteristics conflicting with each other, which characteristics assume a not too low apparent density and a favorable fluidity and nevertheless a not too high carrier own weight (true density) so as to reduce stresses in a developing machine while the configuration has an appropriate void fraction necessary for forming the three-dimensional laminate structures in which resin layers and ferrite layers are alternately present, and the configuration can be accomplished by controlling the characteristics of a ferrite core by combining a number of the above-mentioned methods, and by filling with a resin described later.

Further, there is a method other than the above-mentioned methods, in which method materials to melt, burn or vaporize by heat is mixed with raw materials to constitute a ferrite, granulated, and when or before they are subjected to the ferritization reaction, the materials melt or burn to form voids.

In such materials, if the temperature of melting, burning or vaporizing is too low, the materials are consumed up considerably earlier than the ferritization reaction, and thereafter the ferritization reaction proceeds, thereby having difficulty in forming voids. By contrast, if the temperature of melting, burning or vaporizing is too high, the materials remain in the particles, and voids are not formed.

Such materials are not especially limited, but include $Na_2CO_3$ and various kinds of organic substances.

Further, by adding a material to impede the grain growth during the ferritization reaction, intricate voids can be formed inside the ferrite. Such a material includes $Ta_2O_5$ and $ZrO_2$.

Methods for filling the thus obtained carrier for an electrophotographic developer with a resin involve various ones. The methods include, for example, the dry process method, spray-dry system by a fluidized bed, rotary dry system and liquid immersion-dry method by a universal stirrer. These methods are suitably selected depending on a core and resin to be used.

For forming the three-dimensional laminate structures, a filling resin solution of a lower viscosity is preferable. With too high a viscosity, the resin is hard to fill voids present inside the particles, and the three-dimensional laminate structures are hard to form.

If the resin viscosity is high, the resin can be used by diluting it with various kinds of solvents. The viscosity of the resin solution can be lowered by diluting with a solvent, whereby voids inside the particles are easily filled with the resin, and the three-dimensional laminate structures become easily formed.

In filling with a resin, the interior of an apparatus for filling is preferably depressurized. Under an ordinary pressure or pressurized condition, it is difficult to fill the void inside with a resin, but under reduced pressure, voids inside the particles are effectively and fully filled with the resin, and the three-dimensional laminate structures become easily formed.

The temperature in filling with a resin is required to be precisely controlled. In the case of using a thermosetting resin, if the filling is performed in a higher temperature than that of the curing start, the resin is cured in the vicinity of the particle surface, and sometimes the voids inside the particles cannot be filled with the resin. Filling with the resin is performed preferably at a lower temperature than that of the solvent volatilization. With the temperature being high and with the solvent having a high volatilization rate, the viscosity of the resin solution becomes high during filling, and voids inside the particles sometimes cannot be filled with the resin.

In the case of using a condensation-crosslinkable resin, the amount of by-products generated by the condensation-crosslinking is preferably as less as possible. With too much an amount of the by-products, since the by-products generated during the crosslinking reaction remain inside the particles, the charge property is sometimes deteriorated. If the by-products are discharged outside the particles, a large amount of voids are left inside the particles, sometimes degrading the particle mechanical strengths.

After filling with the resin, heating is performed optionally by various kinds of systems to tightly adhere the filled resin to the core. As the heating system, either of an external heating system and an internal heating system can be used, and, for example, a fixed-type or flow-type electric furnace, a rotary electric furnace, a burner furnace, or the microwave can be used for baking. The temperatures are different depending on the filling resins, and a temperature of not less than the melting point or the glass transition temperature is needed. For a thermosetting resin, a condensation-crosslinkable resin and the like, the temperature is raised to full curing, whereby a resin-filled carrier strong in impact can be obtained.

Methods for further coating the resin as described above on the above-mentioned carrier after the resin filling involve conventional ones, for example, the brush coating method, dry process method, spray dry system by a fluidized bed, rotary dry system and liquid immersion-dry method by a universal stirrer. For improving the coating ratio, the method by a fluidized bed is preferable.

For baking the resin after the resin is coated on the carrier after the resin filling, either of an external heating system and an internal heating system can be used, and, for example, a fixed-type or flow-type electric furnace, a rotary electric furnace, a burner furnace, or the microwave can be used for baking. When a UV-curing resin is employed, a UV heater is used. The temperatures are different depending on the filling resins, and a temperature of not less than the melting point or the glass transition temperature is needed. For a thermosetting resin, a condensation-crosslinkable resin and the like, the temperature needs to be raised to full curing.

<An Electrophotographic Developer According to the Present Invention>

Next, an electrophotographic developer according to the present invention will be explained.

A toner particle constituting a developer of the present invention involves a pulverized toner particle produced by the pulverizing method, and a polymerized toner particle produced by the polymerizing method. In the present invention, the toner particle obtained by either of them can be used.

The pulverized toner particle can be obtained, for example, by fully mixing a binding resin, a charge control agent and a colorant by a mixer such as a Henschel mixer, then melting and kneading by a biaxial extruder, etc., cooling, pulverizing, classifying, adding with external additives, and thereafter mixing by a mixer, etc.

The binding resin constituting the pulverized toner particle is not especially limited, but includes a polystyrene, chloropolystyrene, styrene-chlorostyrene copolymer, styrene-acrylate copolymer, styrene-methacrylate copolymer, and further, a rosin-modified maleic acid resin, epoxide resin, polyester resin and polyurethane resin. These are used alone or by mixing.

As the charge control agent, an optional one can be used. A positively chargeable toner includes, for example, anigrosin dye and a quaternary ammonium salt, and a negatively chargeable toner includes, for example, a metal-containing monoazo dye.

As the colorant (coloring material), conventionally known dyes and pigments are usable. For example, carbon black, phthalocyanine blue, permanent red, chrome yellow, phthalocyanine green and the like can be used. Otherwise, external additives such as a silica powder and titania for improving the fluidity and cohesion resistance of the toner can be added corresponding to the toner particle.

The polymerized toner particle is one produced by a conventionally known method such as the suspension polymerization method, emulsion polymerization method, emulsion coagulation method, ester extension polymerization method and phase transition emulsion method. Such a toner particle by the polymerization methods is obtained, for example, by mixing and stirring a colored dispersion liquid in which a colorant is dispersed in water using a surfactant, a polymerizable monomer, a surfactant and a polymerization initiator in an aqueous medium, emulsifying and dispersing the polymerizable monomer in the aqueous medium, and polymerizing while stirring and mixing. Thereafter, the polymerized dispersion is added with a salting-out agent, and the polymerized particle is salted out. The particle obtained by the salting-out is filtered, washed and dried to obtain the polymerized toner particle. Thereafter, the dried toner particle is optionally added with an external additive.

Further, in producing the polymerized toner particle, a fixability improving agent and a charge control agent can be blended other than the polymerizable monomer, surfactant, polymerization initiator and colorant, thus allowing to control and improve various properties of the polymerized toner particle obtained using these. Besides, for improving the dispersibility of the polymerizable monomer in the aqueous medium, and adjusting the molecular weight of the obtained polymer, a chain-transfer agent can be used.

The polymerizable monomer used for the production of the above-mentioned polymerized toner particle is not especially limited, but includes, for example, styrene and its derivatives, ethylenic unsaturated monoolefins such as ethylene and propylene, halogenated vinyls such as vinyl chloride, vinyl esters such as vinyl acetate, and α-methylene aliphatic monocarboxylate such as methyl acrylate, ethyl acrylate, methyl methacrylate, ethyl methacrylate, 2-ethylhexyl methacrylate, acrylic acid dimethylamino ester and methacrylic acid diethylamino ester.

As the colorant (coloring material) used for preparing the above-mentioned polymerized toner particle, conventionally known dyes and pigments are usable. For example, carbon black, phthalocyanine blue, permanent red, chrome yellow and phthalocyanine green can be used. The surface of colorants may be improved by using a silane coupling agent, a titanium coupling agent and the like.

As the surfactant used for the production of the above-mentioned polymerized toner particle, an anionic surfactant, a cationic surfactant, an amphoteric surfactant and a nonionic surfactant can be used.

Here, the anionic surfactants include sodium oleate, a fatty acid salt such as castor oil, an alkylsulfate such as sodium lauryl sulfate and ammonium lauryl sulfate, an alkylbenzene sulfonate such as sodium dodecylbenzenesulfonate, an alkylnaphthalene sulfonate, an alkyl phosphate, a naphthalenesulfonic acid-formalin condensate, a polyoxyethylene alkyl sulfate, etc. The nonionic surfactants include a polyoxyethylene alkyl ether, a polyoxyethylene aliphatic acid ester, a sorbitan aliphatic acid ester, a polyoxyethylene alkyl amine, glycerin, an aliphatic acid ester, an oxyethylene-oxypropylene blockpolymer, etc. Further, the cationic surfactants include alkylamine salts such as laurylamine acetate, and quaternary ammonium salts such as lauryltrimethylammonium chloride, stearyltrimethylammonium chloride, etc. Then, the amphoteric surfactants include an aminocarboxylate, an alkylamino acid, etc.

A surfactant as described above is generally used in an amount within the range of 0.01 to 10 wt % to a polymerizable monomer. Since the use amount of such a surfactant affects the dispersion stability of the monomer, and affects the environmental dependability of the obtained polymerized toner particle, it is preferably used in the amount within the above range where the dispersion stability of the monomer is secured, and the polymerized toner particle does not excessively affect the environmental dependability.

For the production of the polymerized toner particle, a polymerization initiator is generally used. The polymerization initiators refer to a water-soluble polymerization initiator and an oil-soluble polymerization initiator, and either of them can be used in the present invention. The water-soluble polymerization initiator used in the present invention includes, for example, a peroxosulfate salt such as potassium peroxosulfate, and ammonium peroxosulfate, and a water-soluble peroxide compound. The oil-soluble polymerization initiator includes, for example, an azo compound such as azobisisobutyronitrile, and an oil-soluble peroxide compound.

In the case where a chain-transfer agent is used in the present invention, the chain-transfer agent includes, for example, mercaptans such as octylmercaptan, dodecylmercaptan and tert-dodecylmercaptan, carbon tetrabromide, etc.

Further, in the case where a polymerized toner particle used in the present invention contains a fixation improving agent, as the fixation improving agent, a natural wax such as a carnauba wax, and an olefinic wax such as a polypropylene and a polyethylene can be used.

In the case where a polymerized toner particle used in the present invention contains a charge control agent, the charge control agent to be used is not especially limited, and a nigrosine dye, a quaternary ammonium salt, an organic metal complex, a metal-containing monoazo dye and the like can be used.

An external additive used for improving the fluidity etc. of a polymerized toner particle includes silica, titanium oxide, barium titanate, fluororesin microparticles, acrylic resin microparticles, etc., and these can be used alone or in combination thereof.

Further, the salting-out agent used for separating a polymerized particle from an aqueous medium includes metal salts such as magnesium sulfate, aluminum sulfate, barium chloride, magnesium chloride, calcium chloride and sodium chloride.

The average particle size of the toner particle produced as above is in the range of 2 to 15 μm, preferably in the range of 3 to 10 μm. The polymerized toner particle has the higher uniformity than the pulverized toner particle. The toner particle of less than 2 μm decreases the charging capability and is apt to bring about the fogging of image and toner scattering. That exceeding 15 μm causes the degradation of image quality.

By mixing the carrier and the toner produced as above, an electrophotographic developer is obtained. The mixing ratio of the carrier to the toner, namely, the toner concentration, is preferably set to be 3 to 15%. With less than 3%, a desired image density is hard to obtain. With more than 15%, the toner scattering and fogging of image are apt to occur.

The electrophotographic developer according to the present invention mixed as above can be used in copiers, printers, FAXs, printing machines and the like, in the digital system, which use the development system in which electrostatic latent images formed on a latent image holder having an organic photoconductor layer are reversal-developed by magnetic brushes of the two-component developer having the toner and the carrier while impressing a bias electric field. It is also applicable to full-color machines and the like which use an alternating electric field, which is a method to superimpose an AC bias on a DC bias, when the developing bias is applied from magnetic brushes to the electrostatic latent image side.

Hereinafter, the present invention will be specifically explained by way of examples.

EXAMPLE 1

Raw materials were weighed so as to become MnO: 35 mol %, MgO: 14.5 mol %, $Fe_2O_3$: 50 mol % and SrO: 0.5 mol %, and crushed by a wet media mill for 5 h to obtain a slurry. The obtained slurry was dried by a spray drier to obtain spherical particles. For adjusting the formed void degree, manganese carbonate as the MnO raw material and magnesium hydroxide as the MgO raw material were used. The particles were adjusted for the particle size, and heated at 950° C. for 2 h for calcination. Then, for obtaining a suitable fluidity together with a comparatively high void fraction, the calcined material was crushed by a wet ball mill for one hour using stainless beads of ⅛ inch in diameter, and further crushed for 4 h using stainless beads of 1/16 inch in diameter. An appropriate amount of a dispersant was added to the slurry, and for the purpose of securing the strength of particles to be granulated and adjusting the void degree, 2 wt % of PVA as a binder was added to the solid, and then the mixture was granulated and dried by a spray drier, and held and sintered at a temperature of 1,100° C. at an oxygen concentration of 0 vol % for 4 h in an electric furnace. Thereafter, the sintered material was crushed, further classified for particle size adjustment, and then low magnetic force particles were fractionated by the magnetic separation to obtain a core of ferrite particles. The volume average particle size of this ferrite core was 34.2 μm.

Then, a condensation-crosslinkable methyl-based silicone resin having a solid content of 20 wt % was prepared. The heat loss of the resin at 200° C. was 12 wt %. 1,000 parts by weight of the silicone resin, 3 parts by weight of a conductive carbon (Ketjenblack EC, manufactured by Ketjen Black International), 10 parts by weight of γ-aminopropyltriethoxysilane, and 500 parts by weight of toluene were mixed, and mixed and dispersed by a media mill using zirconia beads of 2 mm.

A mixing vessel was charged with 1,000 parts by weight of the obtained resin solution for filling and the above-mentioned ferrite particles followed by stirring at 50° C. under reduced pressure to fill the ferrite particles with the resin solution. After the particles were fully filled with the resin, the resultant was heated to 70° C., and stirred for 30 min to volatilize toluene.

Thereafter, the resultant was heated to 200° C., stirred for 2 h to cure the resin. The ferrite particles filled with the resin and cured were taken out; aggregation of the particles was loosened by a vibration sieve of 150M in aperture; and non-magnetic substances were removed by using a magnetic separator. Thereafter, coarse particles were again removed by a vibration sieve to obtain a resin-filled ferrite carrier.

As a result of observation of the cross-section of the obtained carrier, the laminate structures were repeated six times, and almost whole of the outermost surface of the particle was coated with the resin. The characteristics (true density, apparent density, average particle size, magnetization, residual magnetization, initial charge quantity, saturated charge quantity, charge quantity after stress, toner breakage, and toner spent amount) were measured by the above-mentioned methods. The results are shown in Table 1. Across-sectional photograph of the resin-filled carrier particle by electron microscopy is shown in FIG. 1.

EXAMPLE 2

A resin-filled ferrite carrier was obtained as in Example 1, except for using 750 parts by weight of a condensation-crosslinkable methyl-based silicone resin, 2 parts by weight of a conductive carbon (Ketjenblack EC, manufactured by Ketjen Black International) and 7.5 parts by weight of γ-aminopropyltriethoxysilane.

As a result of observation of the cross-section of the obtained carrier, the laminate structures were repeated six times, and about 95% of the outermost surface of the particle was coated with the resin. The characteristics were measured as in Example 1. The results are shown in Table 1.

EXAMPLE 3

A ferrite core was obtained as in Example 1, except that the amount of PVA was 0.65 wt % and the sintering temperature was 1, 145° C. The volume average particle size of this ferrite core was 34.8 μm.

Next, 600 parts by weight of the same condensation-crosslinkable methyl-based silicone resin as in Example 1, 2parts by weight of a conductive carbon (Ketjenblack EC, manufactured by Ketjen Black International), 5 parts by weight of γ-aminopropyltriethoxysilane and 500 parts by weight of toluene were mixed, and 2 mm zirconia beads were mixed and dispersed by a media mill.

A mixing vessel was charged with 1,000 parts by weight the obtained resin solution for filling and the above-mentioned ferrite particles, followed by stirring at 50° C. under reduced pressure to fill the ferrite particles with the resin solution. After the particles were fully filled with the resin, the resultant was heated to 70° C., and stirred for 30 min to volatilize toluene.

Thereafter, the resultant was heated to 200° C., stirred for 2 h to cure the resin. The ferrite particles filled with the resin and cured were taken out; aggregation of the particles was loosened by a vibration sieve of 150M in aperture; and non-magnetic substances were removed by using a magnetic separator.

1,000 parts by weight of the obtained resin-filled ferrite particles were coated with 100 parts by weight of the same silicone resin by using a fluidized bed type coating apparatus. After the coating, the resultant was heated at 280° C. for 2 h by using a hot air heater. Thereafter, aggregation of the particles was loosened by a vibration sieve of 150M in aperture, and non-magnetic substances were removed by a magnetic separator. Thereafter, coarse particles were again removed by a vibration sieve to obtain a resin-filled ferrite carrier.

As a result of observation of the cross-section of the obtained carrier, the laminate structures were repeated four times, and about 78% of the outermost surface of the particle was coated with the resin. The characteristics were measured as in Example 1. The results are shown in Table 1.

COMPARATIVE EXAMPLE 1

A ferrite core was the porous CuZn ferrite (an average particle size: 32 μm, BET surface area: about 1,600 $cm^2/g$, manufactured by Powdertech Co., Ltd.) described in an example of Japanese Patent Laid-Open No. 11-295933 (Patent Document 3). Specifically, raw materials were weighed so as to become CuO: 20 mol %, ZnO: 25 mol % and $Fe_2O_3$: 55 mol %, appropriate amounts of a dispersant and a binder were added, and the mixture was crushed by a wet media mill for 5 h to obtain a slurry. The obtained slurry was dried by a spray drier to obtain spherical particles. The particles were adjusted for particle size, and then held and sintered in an atmosphere at about 1,200° C. for 4 h so as to provide a BET surface area of about 1,600 $cm^2/g$. Thereafter, the sintered material was crushed, further adjusted for particle size so as to provide an average particle size of 32 μm, and then low magnetic particles were fractionated by the magnetic separation to obtain a core of ferrite particles.

A filling resin solution was obtained by dissolving 5.5 parts by weight of a thermoplastic acrylic resin (BR-52, manufactured by Mitsubishi Rayon Co., Ltd.) in terms of solid content in 1,000 parts by weight of toluene. A single-screw indirect heating drier was charged with 100 parts by weight of the above-mentioned ferrite core; and the above resin solution was added dropwise thereto while the ferrite core was being held at 120° C. and stirred. After toluene was confirmed to have fully volatilized, the resultant was heated to 150° C. and held for 2 h while stirring. Thereafter, the resultant was taken out from the drier; and aggregated particles were loosened, and adjusted for particle size. Then, low magnetic particles were fractionated by the magnetic separation to obtain a resin-filled carrier particle.

The characteristics were measured as in Example 1. The results are shown in Table 1.

COMPARATIVE EXAMPLE 2

100 parts by weight of an alkoxy-modified silicone (SR-2402, manufactured by DowCorning Toray Co., Ltd.), 10 parts by weight of γ-aminopropyltriethoxysilane and 4 parts by weight of dibutyltin laurate were kneaded by a kneader with 200 parts by weight of magnetite fine particles whose particle size was adjusted to a volume average particle size of 0.75 μm to obtain a paste.

2 parts by weight of calcium phosphate was dispersed in 20 parts by weight of ion exchange water, 1 part by weight of the above paste was added, followed by stirring for 2 min by a homogenizer. The suspension after stirring was heated at 80° C. for 2 h, then cooled to 25° C., followed by addition of hydrochloric acid to dissolve calcium phosphate, and filtered to obtain a filtrate. The obtained filtrate was dried, cured at 80° C. for 2 h, and then crushed to obtain a magnetic powder-dispersed carrier particle.

The characteristics were measured as in Example 1. The results are shown in Table 1.

COMPARATIVE EXAMPLE 3

Raw materials were weighed so as to become MnO: 20 mol % and $Fe_2O_3$: 80 mol %, and crushed by a wet media mill for 5 h to obtain a slurry. The obtained slurry was dried by a spray drier to obtain spherical particles. After the particles were adjusted for particle size, they were heated and calcined at 1,100° C. for 2 h. Then, the calcined particles were crushed by a wet ball mill using stainless beads of ⅛ inch in diameter; thereafter an appropriate amount of a dispersant was added to the obtained slurry, and 1 wt % of PVC as a binder was added to the solid. The obtained slurry was granulated and dried by a spray drier, and held and sintered at a temperature of 1,300° C. at an oxygen concentration of 0 vol. % for 4 h in an electric furnace. Thereafter, the sintered particles were crushed, further classified and adjusted for particle size, and then low magnetic particles were fractionated by the magnetic separation to obtain a core of ferrite particles. The ferrite core had a volume average particle size of 36 μm.

Next, 110 parts by weight of the same condensation-crosslinkable methyl-based silicone resin as in Example 1, 1.1 parts by weight of a conductive carbon (Ketjenblack EC, manufactured by Ketjen Black International), 2.2 parts by weight of γ-aminopropyltriethoxysilane, and 500 parts by weight of toluene were mixed, and 2 mm zirconia beads were mixed and dispersed by a media mill.

1,000 parts by weight of the above-mentioned ferrite particles were coated with the above resin solution by using a fluidized bed type coating apparatus. After coating, the resultant was heated at 220° C. for 3 h by using a hot air heater. Thereafter, aggregation of the particles was loosened by a vibration sieve of 150M in aperture, and non-magnetic substances were removed by using a magnetic separator. Then, coarse particles were removed again by a vibration sieve to obtain a resin-coated ferrite carrier.

The characteristics were measured as in Example 1. The results are shown in Table 1. A cross-sectional photograph of the carrier particle by electron microscopy is shown in FIG. 2.

TABLE 1

| | | Characteristics after resin filling | | | | | | | |
|---|---|---|---|---|---|---|---|---|---|
| | Core composition | Filling resin | Resin filling amount (parts by weight) | Repeating of three-dimensional laminate structures (average) | Depth of three-dimensional laminate structures | Resin coating ratio of outermost surface | True density ($g/cm^3$) | Apparent density ($g/cm^3$) | Volume average particle size (μm) |
| Ex. 1 | Mn—Mg—Sr Ferrite | Silicone resin | 20.0 | 6 times | Present to near center (100%) | Almost whole surface coated (100%) | 3.35 | 1.52 | 35.8 |

TABLE 1-continued

| | | | | | | | | | |
|---|---|---|---|---|---|---|---|---|---|
| Ex. 2 | Mn—Mg—Sr Ferrite | Silicone resin | 15.0 | 6 times | Present to near center (100%) | 95% | 3.61 | 1.65 | 35.1 |
| Ex. 3 | Mn—Mg—Sr Ferrite | Silicone resin | 12.0 | 4 times | Present to near center (100%) | 78% | 3.69 | 1.73 | 36.7 |
| Com. Ex. 1 | Cu—Zn Ferrite | Acrylic resin | 5.5 | 1 time | None | 67% | 4.52 | 2.01 | 57.4 |
| Com. Ex. 2 | Magnetic powder-dispersed type | — | — | — | — | — | 2.15 | 0.86 | 18.5 |
| Com. Ex. 3 | Mn Ferrite | Silicone resin | — | 1 time | None | 89% | 4.89 | 2.31 | 43.3 |

| | Characteristics after resin filling | | | | | | | |
|---|---|---|---|---|---|---|---|---|
| | Magnetization ($A \cdot m^2/kg$) | Residual magnetization ($A \cdot m^2/kg$) | Strength (%) | Initial charge quantity (μC/g) | Saturated charge quantity (μC/g) | Charge quantity after stress (μC/g) | Toner breakage | Toner spent amount (%) |
| Ex. 1 | 60 | 2 | 98.3 | 31.9 | 32.5 | 31.6 | Little seen | 0.2 |
| Ex. 2 | 61 | 2 | 97.4 | 29.0 | 30.3 | 28.9 | Little seen | 0.3 |
| Ex. 3 | 64 | 1 | 97.8 | 27.2 | 29.4 | 30.3 | Little seen | 0.5 |
| Com. Ex. 1 | 58 | 3 | 93.2 | 14.3 | 10.9 | 5.8 | Very much seen | 7.2 |
| Com. Ex. 2 | 37 | 15 | 59.1 | 15.5 | 31.4 | 4.7 | Little seen | 6.6 |
| Com. Ex. 3 | 76 | 3 | 80.8 | 10.4 | 22.9 | 8.2 | Very much seen | 9.1 |

As clarified from the results shown in Table 1, the carriers obtained in Examples 1 to 3 have high strengths in spite of low specific gravities, have high initial charge quantities, and are excellent in the charging speeds. Also after stresses, they do not cause the toner breakage, have only a little toner spent, and little changes in charge quantities in comparison between the initial, the saturated and the after-stress ones.

The carriers obtained in Comparative Example 1 and Comparative Example 3 have high true densities as compared with the carriers obtained in Examples 1 to 3, and have aggregation generated at resin filling as evidenced from the volume average particle sizes. Further, much toner breakage by stirring of 36 h is observed, and the toner spent is simultaneously large. Hence, large differences between the initial charge quantities and the charge quantities after stress are generated, thereby not providing stable characteristics.

The magnetic powder-dispersed carrier in Comparative Example 2 has a low strength, a poor fluidity, and a large difference between the initial charge quantity and the saturated charge quantity, and a very slow charging speed. After stirring of 36 h, although the toner breakage is not observed, it has a much toner spent, and a very low charge quantity after stress and a poor stability additionally by the influence of the carrier being broken. Micropowder containing magnetic powder generated by the carrier breakage cannot be held on a magnet roll because of a low magnetization of the particles, and the scattering amount has a poor result.

The carrier for an electrophotographic developer according to the present invention has a low true density and can achieve an elongated life because since it is a resin-filled ferrite carrier and a resin is present to the vicinity of the center inside the particles, and has an excellent charge imparting capability and its stability because it has a capacitor-like property with laminate structures composed of resin layers and ferrite layers. Further, the charge quantity, etc. can be easily controlled through selection of resins. Moreover, it has a high strength in comparison with magnetic powder-dispersed carriers, and no cracking, deformation nor melting by heat and impact.

Accordingly, the electrophotographic developer using the resin-filled carrier secures sufficiently the image density, and can maintain high-quality images for a long period, so it is usable especially in the fields of full-color machines requiring high-quality images and high-speed machines requiring reliability and durability of image sustainability.

What is claimed is:

1. A carrier for an electrophotographic developer which is a resin-filled ferrite carrier obtained by filling, with a resin, a void of a porous ferrite core whose void continues from the surface to reach the inside of the core, the carrier comprising a three-dimensional plurality of laminate structures in which resin layers and ferrite layers are alternately present.

2. The carrier for an electrophotographic developer according to claim 1, wherein the three-dimensional laminate structures are repeated in three or more times.

3. The carrier for an electrophotographic developer according to claim 1, wherein the three-dimensional laminate structures are present at least in the part to the depth of 10% or more in radius in the diameter direction directing from the particle surface to the particle center.

4. The carrier for an electrophotographic developer according to claim 1, wherein 50% or more of the outermost surface of the carrier is coated with a resin.

5. The carrier for an electrophotographic developer according to claim 1, wherein the carrier has a true density of 2.5 to 4.5 $g/cm^3$, an apparent density of 1.0 to 2.3 $g/cm^3$, and an average particle size of 20 to 40 μm.

6. The carrier for an electrophotographic developer according to claim 1, wherein the carrier has a residual magnetization of 5 emu/g ($A \cdot m^2/kg$) or less, and a magnetization of 40 to 75 emu/g ($A \cdot m^2/kg$).

7. An electrophotographic developer comprising the carrier for an electrophotographic developer according to claim 1 and a toner.

* * * * *